US009010124B2

(12) United States Patent
Chandler et al.

(10) Patent No.: US 9,010,124 B2
(45) Date of Patent: Apr. 21, 2015

(54) COOLED DOUBLE WALLED ARTICLE

(75) Inventors: Paul I. Chandler, Birmingham (GB); Anthony Pidcock, Derby (GB)

(73) Assignee: ROLLS-ROYCE plc, London (GB)

( * ) Notice: Subject to any disclaimer, the term of this patent is extended or adjusted under 35 U.S.C. 154(b) by 540 days.

(21) Appl. No.: 13/421,293

(22) Filed: Mar. 15, 2012

(65) Prior Publication Data

US 2012/0255308 A1 Oct. 11, 2012

(30) Foreign Application Priority Data

Apr. 6, 2011 (GB) ..... 1105790.8

(51) Int. Cl.
*F23R 3/06* (2006.01)
*F23R 3/00* (2006.01)

(52) U.S. Cl.
CPC . *F23R 3/06* (2013.01); *F23R 3/002* (2013.01); *F23R 2900/03041* (2013.01); *F23R 2900/03044* (2013.01)

(58) Field of Classification Search
CPC ..... F23R 3/002; F23R 3/06; F23R 3/04; F23R 2900/03044; F23R 2900/03041; Y02T 50/675
USPC ..... 60/740, 748, 752–760
See application file for complete search history.

(56) References Cited

U.S. PATENT DOCUMENTS 5,435,139 A * 7/1995 Pidcock et al. ..... 60/757
5,799,491 A * 9/1998 Bell et al. ..... 60/752
6,546,731 B2 * 4/2003 Alkabie et al. ..... 60/754
6,546,733 B2 * 4/2003 North et al. ..... 60/772
6,964,170 B2 11/2005 Alkabie
7,140,185 B2 * 11/2006 Burd ..... 60/752
7,926,278 B2 * 4/2011 Gerendas et al. ..... 60/725
2001/0004835 A1 6/2001 Alkabie et al.
2010/0037620 A1 * 2/2010 Chila ..... 60/752

FOREIGN PATENT DOCUMENTS

EP 0 576 435 B1 8/1995
GB 1 530 594 11/1978
GB 2 173 891 A 10/1986

OTHER PUBLICATIONS

British Search Report dated Aug. 23, 2011 issued in British Patent Application No. GB 1105790.8.

* cited by examiner

*Primary Examiner* — Phutthiwat Wongwian
*Assistant Examiner* — Steven Sutherland
(74) *Attorney, Agent, or Firm* — Oliff PLC

(57) ABSTRACT

A gas turbine engine combustion chamber includes a first wall and a second wall. The second wall is arranged within and spaced from the first wall to define a cavity between the first wall and the second wall. The first wall has a plurality of impingement apertures extending there-through and the second wall has a plurality of effusion apertures extending there-through. The impingement apertures have a first diameter, a first pitch, and a first area. The effusion apertures have a second diameter, a second pitch, and a second area. The ratio of the first diameter to the second diameter is at least 3, the ratio of the first pitch to the second pitch is at least 4 and the ratio of the first area to the second area is at least 9. This arrangement increases the cooling performance of the effusion apertures in the second wall.

26 Claims, 4 Drawing Sheets

COOLED DOUBLE WALLED ARTICLE

The present invention relates to a cooled double walled article and in particular relates to a gas turbine engine cooled double walled article. The present invention more particularly relates to a combustion chamber, a turbine blade, a turbine vane or a turbine shroud or other cooled double walled articles which comprise double walled structures.

Currently gas turbine engine combustion chambers comprise double walled structures comprising a first wall and a second wall arranged within and spaced from the first wall to form a cavity between the first wall and the second wall. The first wall has a plurality of impingement apertures extending there-through, whereby during operation a flow of coolant is arranged to flow through the impingement apertures and impinge upon an outer surface of the second wall. The second wall has a plurality of effusion apertures extending there-through, whereby in operation a flow of coolant is arranged to flow from the cavity through the effusion apertures and into the combustion chamber. Our European patent EP0576435B1 is an example. Typically the impingement apertures in the first wall have the same diameter as the effusion apertures in the second wall, but there are twice as many effusion apertures in the second wall as there are impingement apertures in the first wall. The impingement of coolant on the outer surface of the second wall provides impingement cooling of the second wall. The coolant flows through the effusion apertures in the second wall to provide convective cooling of the second wall and the coolant flow out of the effusion apertures to form a film of coolant on the inner surface of the second wall to protect the inner surface of the second wall from combustion gases in the combustor.

A problem with the use of this arrangement is that under some circumstances, for example due to manufacturing and/or location tolerances of the first wall and the second wall, it is possible for an impingement aperture in the first wall to be located directly in alignment with an effusion aperture in the second wall and this eventuality is undesirable. In some circumstances a plurality of impingement apertures in the first wall could be located such that each of the plurality of impingement apertures in the first wall was located directly in alignment with a respective one of the effusion apertures in the second wall. In a normal arrangement each of the impingement apertures in the first wall is located such that the coolant issuing from the impingement aperture impinges on the outer surface of the second wall and the coolant is then shared equally between the two effusion holes associated with that impingement aperture. However, if an impingement aperture in the first wall is located in alignment with one of the effusion apertures in the second wall then the coolant issuing from the impingement aperture is preferentially supplied through that effusion aperture and the other effusion aperture associated with that impingement aperture is not supplied with coolant. This leads to a reduction in the cooling performance of the second wall, due to a lack of, or reduced, convective cooling occurring in the other effusion aperture and a lack of, or reduced, film cooling of the inner surface of the second wall from the other effusion aperture.

Accordingly the present invention seeks to provide a cooled double walled article comprising a first wall and a second wall spaced from the first wall which reduces the above-mentioned problem and has improved cooling.

Accordingly the present invention seeks to provide a combustion chamber comprising a first wall and a second wall arranged within and spaced from the first wall which reduces the above-mentioned problem and has improved cooling.

Accordingly the present invention a cooled double walled article comprising a first wall and a second wall, the second wall is spaced from the first wall to define a cavity between the first wall and the second wall, the first wall having a plurality of impingement apertures extending there-through, whereby during operation a flow of coolant is arranged to flow through the impingement apertures and impinge upon a first surface of the second wall, the second wall having a plurality of effusion apertures extending there-through, whereby in operation a flow of coolant is arranged to flow from the cavity through the effusion apertures and onto a second surface of the second wall, the impingement apertures have a first diameter, the effusion apertures have a second diameter, the impingement apertures have a first pitch, the effusion apertures have a second pitch, the first pitch is the distance between the centres of two adjacent impingement apertures, the second pitch is the distance between the centres of two adjacent effusion apertures, the impingement apertures have a first area, the effusion apertures have a second area, whereby the ratio of the first diameter to the second diameter is at least 3, the ratio of the first pitch to the second pitch is at least 4 and the ratio of the first area to the second area is at least 9.

The ratio of the first diameter to the second diameter may be at least 4, the ratio of the first pitch to the second pitch is at least 5 and the ratio of the first area to the second area is at least 16.

The ratio of the first diameter to the second diameter may be 3, the ratio of the first pitch to the second pitch is 4.2 and the ratio of the first area to the second area is 9.

The ratio of the first diameter to the second diameter may be 4, the ratio of the first pitch to the second pitch is 5.7 and the ratio of the first area to the second area is 16.

The effusion apertures may have a minimum diameter of 0.5 mm.

The effusion apertures may have a diameter of 0.5 mm, the second pitch is 2.8 mm, the number of effusion apertures per square inch is 98, the impingement apertures have a diameter of 1.5 mm, the first pitch is 11.7 mm and the number of impingement apertures per square inch is 5.

The effusion apertures may have a diameter of 0.5 mm, the second pitch is 2.8 mm, the number of effusion apertures per square inch is 98, the impingement apertures have a diameter of 2 mm, the first pitch is 15.6 mm and the number of impingement apertures per square inch is 3.

The effusion apertures may have a diameter of 0.5 mm, the second pitch is 3.9 mm, the number of effusion apertures per square inch is 49, the impingement apertures have a diameter of 1.5 mm, the first pitch is 16.5 mm and the number of impingement apertures per square inch is 3.

The effusion apertures may have a diameter of 0.5 mm, the second pitch is 3.9 mm, the number of effusion apertures per square inch is 49, the impingement apertures have a diameter of 2 mm, the first pitch is 22.1 mm and the number of impingement apertures per square inch is 2.

The effusion apertures may have a diameter of 0.5 mm, the second pitch is 1.9 mm, the number of effusion apertures per square inch is 196, the impingement apertures have a diameter of 1.5 mm, the first pitch is 8.3 mm and the number of impingement apertures per square inch is 11.

The effusion apertures may have a diameter of 0.5 mm, the second pitch is 1.9 mm, the number of effusion apertures per square inch is 196, the impingement apertures have a diameter of 2 mm, the first pitch is 11 mm and the number of impingement apertures per square inch is 6.

The centres of the impingement apertures may be arranged at the corners of an equilateral triangle and the centres of the effusion apertures are arranged at the corners of an equilateral triangle.

The effusion apertures may be arranged at an angle of at least 15° to the surface of the second wall. The effusion apertures may be arranged at an angle of 20° to the surface of the second wall. The effusion apertures may be arranged at an angle of 90° to the surface of the second wall.

The cooled double walled article may be a combustion chamber, a turbine blade, a turbine vane or a turbine shroud.

The combustion chamber may be a tubular combustion chamber and the first wall is an annular wall and the second wall is an annular wall.

The combustion chamber may be a tubular combustion chamber and the first wall is an annular wall and the second wall comprises a plurality of tiles arranged circumferentially and axially to define an annular wall.

The combustion chamber may be an annular combustion chamber and the first wall is an inner annular wall and the second wall is an annular wall arranged radially outwardly of the first wall or the first wall is an outer annular wall and the second wall is an annular wall arranged radially inwardly of the first wall.

The combustion chamber may be an annular combustion chamber and the first wall is an inner annular wall and the second wall comprises a plurality of tiles arranged circumferentially and axially to define an annular wall arranged radially outwardly of the first wall or the first wall is an outer annular wall and the second wall comprises a plurality of tiles arranged circumferentially and axially to define an annular wall arranged radially inwardly of the first wall.

The combustion chamber may be an annular combustion chamber and the first wall is an annular upstream end wall and the second wall comprises a plurality of heat shields arranged circumferentially to define an annular wall arranged downstream of the first wall.

The plurality of impingement apertures and the plurality of effusion apertures may be arranged over at least a portion of the first wall and at least a portion of the second wall.

The at least a portion of the first wall and the at least a portion of the second wall may be arranged at a position downstream of a mixing port extending through the first wall and second wall.

The plurality of impingement apertures and the plurality of effusion apertures may be arranged over all of the first wall and over all of the second wall respectively. The plurality of effusion apertures may be arranged over all of at least one of the tiles. The plurality of effusion apertures may be arranged over all of each of the tiles.

The impingement apertures may have a diameter equal to or greater than 1.5 mm and equal to or less then 2 mm. The first pitch may be equal to or greater than 8.3 mm and equal to or less than 22.1 mm. The number of impingement apertures per square inch may be equal to or greater than 2 and equal to or less than 11. The number of impingement apertures per square cm may be equal to or greater than 0.2 and equal to or less than 1.7. The second pitch may be equal to or greater than 1.9 mm and equal to or less than 3.9 mm. The number of effusion apertures per square inch may be equal to or greater than 49 and equal to or less than 196. The number of effusion apertures per square cm may be equal to or greater than 8 and equal to or less than 30. The ratio of the number of effusion apertures per square inch to the number of impingement apertures per square inch may be equal to greater than 16 and equal to or less than 33. The ratio of the number of effusion apertures to the number of impingement apertures may be equal to greater than 18 and equal to or less than 32. The ratio of the second pitch to the second diameter may be equal to or greater than 3.8 and equal to or less than 7.8. The ratio of the first pitch to the first diameter may be equal to or greater than 5.5 and equal to or less than 11. The ratio of the first pitch to the first diameter may be greater than the ratio of the second pitch to the second diameter.

The present invention also provides a combustion chamber comprising a first wall and a second wall, the second wall is arranged within and spaced from the first wall to define a cavity between the first wall and the second wall, the first wall having a plurality of impingement apertures extending therethrough, whereby during operation a flow of coolant is arranged to flow through the impingement apertures and impinge upon an outer surface of the second wall, the second wall having a plurality of effusion apertures extending therethrough, whereby in operation a flow of coolant is arranged to flow from the cavity through the effusion apertures and into the combustion chamber, the impingement apertures have a first diameter, the effusion apertures have a second diameter, the impingement apertures have a first pitch, the effusion apertures have a second pitch, the first pitch is the distance between the centres of two adjacent impingement apertures, the second pitch is the distance between the centres of two adjacent effusion apertures, the impingement apertures have a first area, the effusion apertures have a second area, whereby the ratio of the first diameter to the second diameter is at least 3, the ratio of the first pitch to the second pitch is at least 4 and the ratio of the first area to the second area is at least 9.

The present invention will be more fully described by way of example with reference to the accompanying drawings, in which.

Figure 1:
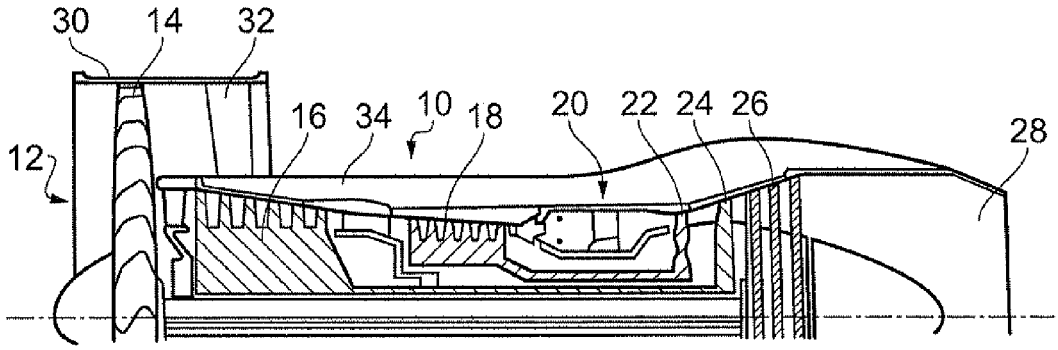
FIG. 1 is a cut-away view of a turbofan gas turbine engine having a combustion chamber according to the present invention.

A turbofan gas turbine engine 10, as shown in FIG. 1, comprises in axial flow series an intake 12, a fan 14, an intermediate pressure compressor 16, a high pressure compressor 18, a combustor 20, a high pressure turbine 22, an intermediate pressure turbine 24, a low pressure turbine 26 and an exhaust 28. The fan 14 is surrounded by a fan casing 30 and the fan casing 30 is secured to a core casing 34 via a plurality of fan outlet guide vanes 32.

Figure 2:
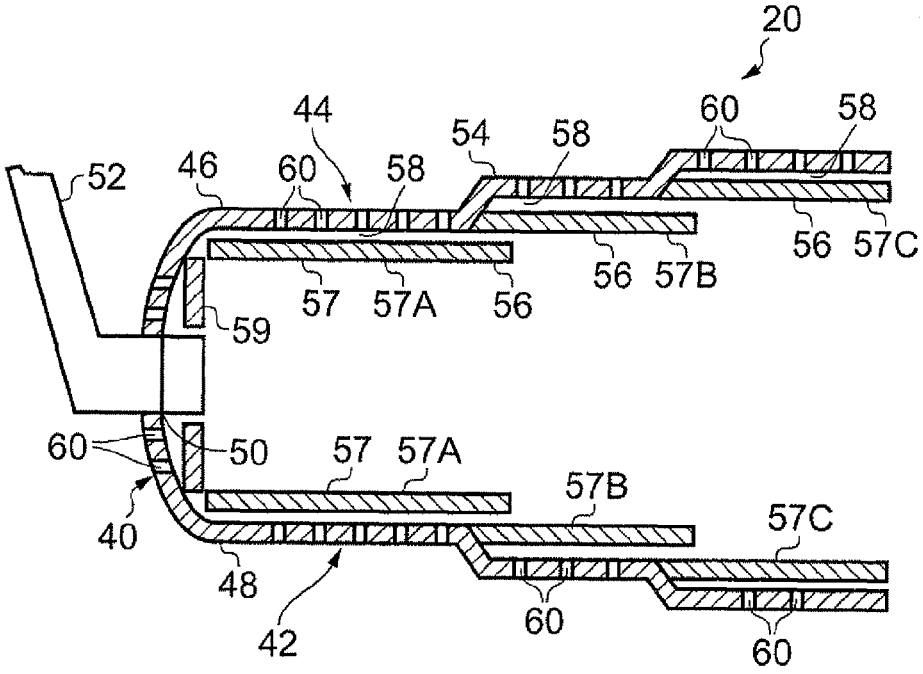
FIG. 2 is an enlarged cross-sectional view through a combustion chamber according to the present invention.

The combustion chamber 20 is shown more clearly in FIG. 2 and the combustion chamber 20 is an annular combustion chamber and comprises an upstream end wall 40, an inner annular wall 42 and an outer annular wall 44, the upstream ends 46 and 48 of the inner and outer annular walls 42 and 44 respectively are secured to the upstream end wall 40. The upstream end wall 40 has a plurality of apertures 50 in which are located fuel nozzles 52 in order to supply fuel and air into the annular combustion chamber 20. The upstream end wall 40, the inner annular wall 42 and the outer annular wall 44 are double wall arrangements.

Figure 3:
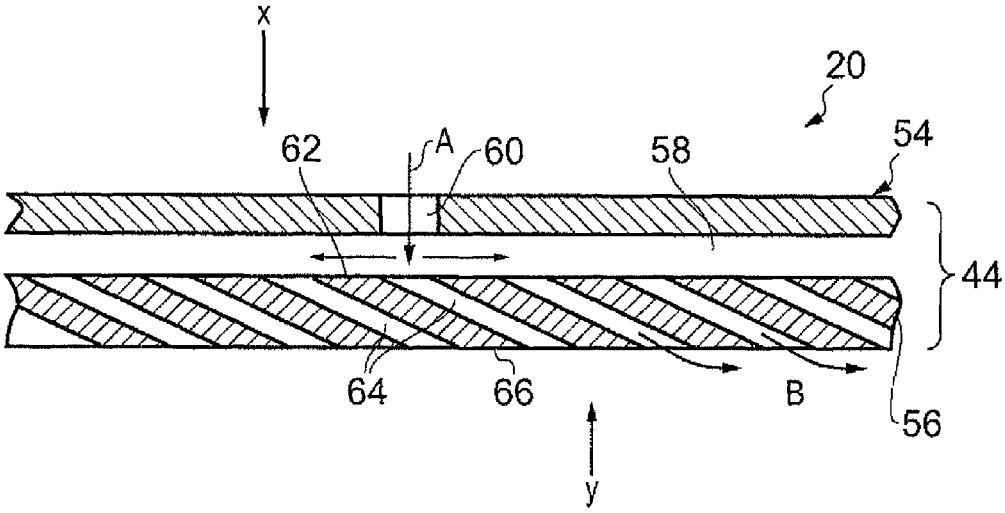
FIG. 3 is a further enlarged cross-sectional view through the combustion chamber shown in FIG. 2.

The double wall arrangement of the outer annular wall 44 is shown in FIG. 3 and the outer annular wall 44 comprises a first wall 54 and a second wall 56. The second wall 56 is arranged within and spaced from the first wall 54 to define a cavity 58 between the first wall 54 and the second wall 56. The first wall 54 has a plurality of impingement apertures 60 extending there-through, whereby during operation a flow of coolant, as shown by arrow A, is arranged to flow through the impingement apertures 60 into the cavity 58 and impinge upon an outer surface 62 of the second wall 56. The second wall 56 has a plurality of effusion apertures 64 extending there-through, whereby in operation a flow of coolant, as shown by arrow B, is arranged to flow from the cavity 58 through the effusion apertures 64 and into the combustion chamber to provide a film of coolant on the inner surface 66 of the second wall 56. The centres of the impingement apertures 60 are arranged at the corners of an equilateral triangle and the centres of the effusion apertures 64 are arranged at the corners of an equilateral triangle. The effusion apertures 64 may be arranged at an angle of between 15° to 90° to the surface of the second wall 56. Higher angles, e.g. closer to 90°, allow the number of effusion holes to be increased.

In this arrangement the double wall arrangement of the outer annular wall 44 comprises a fully annular first wall 54 and the second wall 56 comprises a plurality of tiles 57 arranged circumferentially and axially to define an annular second wall 56, arranged radially inwardly of the annular first wall 54. Thus, there is a first plurality of tiles 57A arranged circumferentially side by side, edge to edge, to form an annulus, a second plurality of tiles 57B arranged circumferentially side by side, edge to edge, to form an annulus and a third plurality of tiles 57C arranged circumferentially side by side, edge to edge, to form an annulus. The second plurality of tiles 57B are arranged downstream of the first plurality of tiles 57A and the downstream ends of the first plurality of tiles 57A overlap but are spaced radially inwardly from the upstream ends of the second plurality of tiles 57B. The third plurality of tiles 57C are arranged downstream of the second plurality of tiles 57B and the downstream ends of the second plurality of tiles 57B overlap but are spaced radially inwardly from the upstream ends of the third plurality of tiles 57C. The double wall arrangement of the inner annular wall 42 may be arranged similarly, but the downstream ends of the upstream tiles 57A, 57B overlap but are spaced radially outwardly from the upstream ends of the downstream tiles 57B, 57C respectively. The double wall arrangement of the upstream end wall 40 may be arranged similarly, but there are a plurality of heat shields 59 in the second wall arranged downstream from the first wall.

Figure 4:
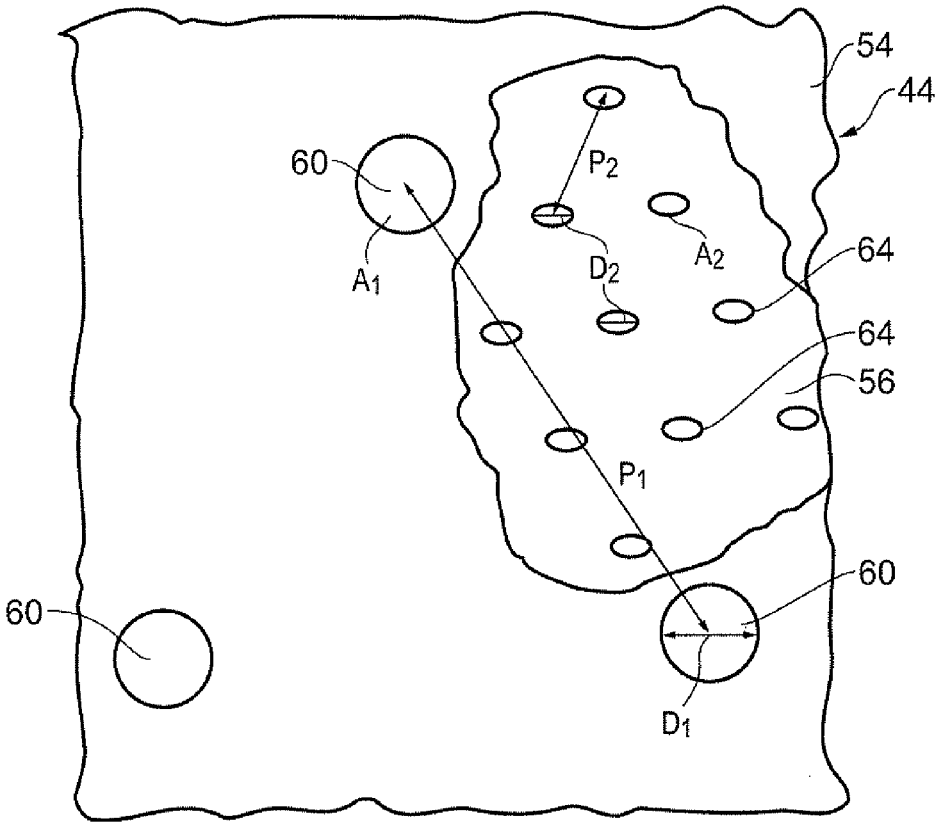
FIG. 4 is a partially cut-away view in the direction of arrow X in FIG. 3 showing a first and second wall of the combustion chamber.

The impingement apertures 60 have a first diameter $D_1$, the effusion apertures 64 have a second diameter $D_2$, the impingement apertures 60 have a first pitch $P_1$ and the effusion apertures 64 have a second pitch $P_2$, as shown in FIG. 4. The first pitch $P_1$ is the distance between the centres of two adjacent impingement apertures 60. The second pitch $P_2$ is the distance between the centres of two adjacent effusion apertures 64. The impingement apertures 60 have a first area $A_1$, the effusion apertures 64 have a second area $A_2$, whereby the ratio of the first diameter $D_1$ to the second diameter $D_2$ is at least 3, the ratio of the first pitch $P_1$ to the second pitch $P_2$ is at least 4 and the ratio of the first area $A_1$ to the second area $A_2$ is at least 9.

The ratio of the first diameter $D_1$ to the second diameter $D_2$ is at least 4, the ratio of the first pitch $P_1$ to the second pitch $P_2$ is at least 5 and the ratio of the first area $A_1$ to the second area $A_2$ is at least 16.

The ratio of the first diameter $D_1$ to the second diameter $D_2$ may be 3, the ratio of the first pitch $P_1$ to the second pitch $P_2$ is 4.2 and the ratio of the first area $A_1$ to the second area $A_2$ is 9.

The ratio of the first diameter $D_1$ to the second diameter $D_2$ may be 4, the ratio of the first pitch $P_1$ to the second pitch $P_2$ is 5.7 and the ratio of the first area $A_1$ to the second area $A_2$ is 16.

The effusion apertures 64 have a minimum second diameter $D_2$ of 0.5 mm in order to avoid blockage of the effusion apertures 64 during operation. The impingement apertures 60 may have a minimum first diameter $D_1$ of 1.5 mm.

In one embodiment of the present invention in which the overall wall cooling porosity is 1%, where the overall wall cooling is effective flow area as a percentage of the wall area, the effusion apertures 60 have a second diameter $D_2$ of 0.5 mm, the second pitch $P_2$ is 2.8 mm, the number of effusion apertures 64 per square inch is 98 (the number of effusion apertures 64 per square cm is 15), the impingement apertures 60 have a first diameter $D_1$ of 1.5 mm, the first pitch $P_1$ is 11.7 mm and the number of impingement apertures 60 per square inch is 5 (the number of impingement apertures 60 per square cm is 0.8).

In a second embodiment of the present invention in which the overall wall cooling porosity is 1% the effusion apertures 64 have a second diameter $D_2$ of 0.5 mm, the second pitch $P_2$ is 2.8 mm, the number of effusion apertures 64 per square inch is 98 (the number of effusion apertures 64 per square cm is 15), the impingement apertures 60 have a first diameter $D_1$ of 2 mm, the first pitch $P_1$ is 15.6 mm and the number of impingement apertures 60 per square inch is 3 (the number of impingement apertures 60 per square cm is 0.5).

In a third embodiment of the present invention in which the overall wall cooling porosity is 0.5% the effusion apertures 64 have a second diameter $D_2$ of 0.5 mm, the second pitch $P_2$ is 3.9 mm, the number of effusion apertures 64 per square inch is 49 (the number of effusion apertures 64 per square cm is 8), the impingement apertures 60 have a first diameter $D_1$ of 1.5 mm, the first pitch $P_1$ is 16.5 mm and the number of impingement apertures 60 per square inch is 3 (the number of impingement apertures 60 per square cm is 0.4).

In a fourth embodiment of the present invention in which the overall wall cooling porosity is 0.05% the effusion apertures 64 have a second diameter $D_2$ of 0.5 mm, the second pitch $P_2$ is 3.9 mm, the number of effusion apertures 64 per square inch is 49 (the number of effusion apertures 64 per square cm is 8), the impingement apertures 60 have a first diameter $D_1$ of 2 mm, the first pitch $P_1$ is 22.1 mm and the number of impingement apertures 60 per square inch is 2 (the number of impingement apertures 60 per square cm is 0.2).

In a fifth embodiment of the present invention in which the overall wall cooling porosity is 2%, the effusion apertures 64 have a second diameter $D_2$ of 0.5 mm, the second pitch $P_2$ is 1.9 mm, the number of effusion apertures 64 per square inch is 196 (the number of effusion apertures 64 per square cm is 30), the impingement apertures 60 have a first diameter $D_1$ of 1.5 mm, the first pitch $P_1$ is 8.3 mm and the number of impingement apertures 60 per square inch is 11 (the number of impingement apertures 60 per square cm is 1.7).

In a sixth embodiment of the present invention in which the overall wall cooling porosity is 2%, the effusion apertures 64 have a second diameter $D_2$ of 0.5 mm, the second pitch $P_2$ is 1.9 mm, the number of effusion apertures 64 per square inch is 196 (the number of effusion apertures 64 per square cm is 30), the impingement apertures 60 have a first diameter $D_1$ of 2 mm, the first pitch $P_1$ is 11 mm and the number of impingement apertures 60 per square inch is 6 (the number of impingement apertures 60 per square cm is 0.9).

Other suitable arrangements may be used, in which the overall wall cooling porosity is between and including 0.05% to 3%.

The pressure drop across the first wall 54 of the double wall arrangement is 80% of the total pressure drop and the pressure drop across the second wall 56 of the double wall arrangement is 20% of the total pressure drop.

In the present invention each impingement aperture 60 in the first wall 54 supplies coolant, air, to a large number of effusion apertures 64 in the second wall 56, for example one impingement aperture 60 supplies coolant to eighteen or thirty two effusion apertures 64. In operation of the present invention if one of the effusion apertures 64 in the second wall 56 is aligned with one of the impingement apertures 60 in the first wall 54, due to manufacturing tolerances and/or location tolerances, then this effusion aperture 64 aligned with the impingement aperture 60 takes only a small proportion of the coolant discharged by the impingement aperture 60 and the remaining coolant is shared, equally, between the remaining effusion apertures 64. In the case of one impingement aperture 60 supplying coolant to eighteen effusion apertures 64, only 11% of the coolant supplied by impingement aperture 60 flows through the aligned effusion aperture 64 and the remaining 89% of the coolant is supplied to the remaining seventeen effusion apertures 64 and this results in each of the remaining effusion apertures 64 receiving 94% of the coolant it would have received if the effusion aperture 64 was not aligned with the impingement aperture 60. If this is compared with the previous arrangement discussed above in which an effusion aperture in the second wall is aligned with an impingement aperture in the first wall all of the coolant supplied by that impingement aperture would flow through the aligned effusion aperture and no coolant would be supplied to the other effusion apertures associated with that impingement aperture and this results in a reduction in the cooling performance of the second wall, due to a lack of, or reduced, convective cooling occurring in the other effusion apertures and a lack of, or reduced, film cooling of the inner surface of the second wall from the other effusion apertures.

The advantage of using impingement apertures 60 and effusion apertures 64 in an arrangement according to the present invention is that there is no need to maintain the first wall and second wall 54 and 56 in an accurate location. The impingement apertures 60 and effusion apertures 64 in an arrangement according to the present invention reduces the positional sensitivity of the impingement apertures 60 and effusion apertures 64 and in particular it allows large numbers of effusion apertures 64 to be used in the second wall 56 and this increases both the convective cooling and film cooling of the second wall 56. The impingement apertures 60 and effusion apertures 64 in an arrangement according to the present invention maintains a more uniform feed of coolant to the effusion apertures thereby increasing the cooling performance of the effusion apertures in the second wall 56. The present invention also allows minimum effusion aperture 64 diameters, minimum pitches between effusion apertures 64 and larger impingement aperture 60 diameters and this increases the surface area for convective cooling and film cooling effectiveness of the second wall resulting in enhanced cooling performance.

Figure 5:
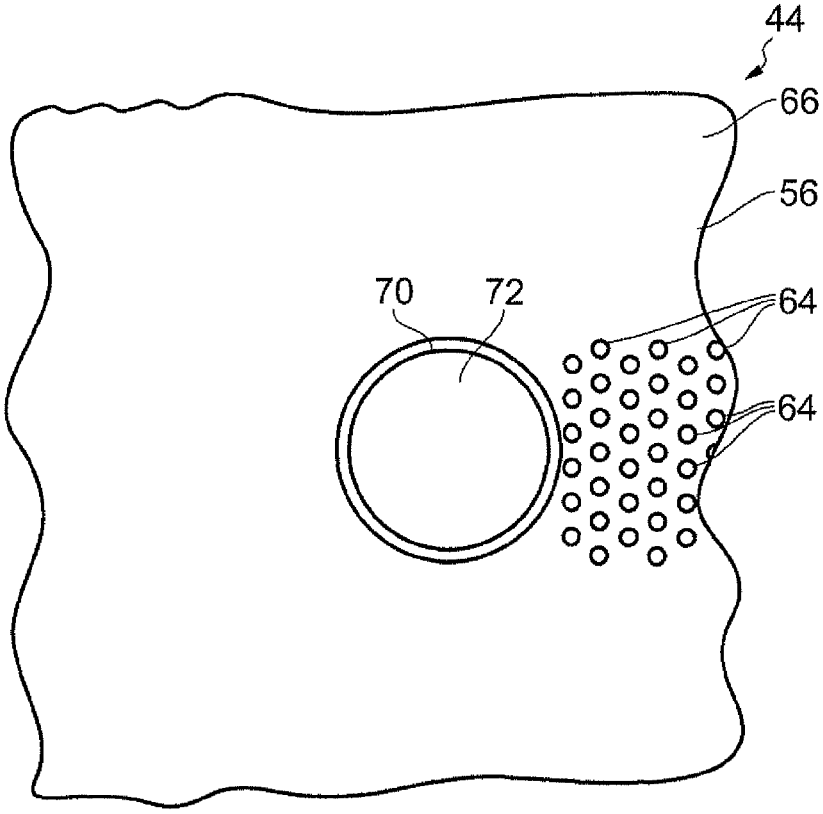
FIG. 5 is a view in the direction of arrow Y in FIG. 3.

FIG. 5 shows an outer annular wall 44 which has one or more mixing ports 70 to define one or more mixing ducts 72 to supply mixing air into the annular combustion chamber 20. A plurality of impingement apertures 60 and a plurality of effusion apertures 64 are arranged over at least a portion of the first wall 54 and at least a portion of the second wall 56. In this arrangement the at least a portion of the first wall 54 and the at least a portion of the second wall 56 is arranged at a position downstream of the, or each, mixing port 70 extending through the first wall 54 and the second wall 56 of the outer annular wall 44. The same arrangement may be provided on an inner annular wall 42. The effusion apertures 64 positioned downstream of the mixing ports 70 are arranged at an angle of 90° to the inner surface of 66 of the second wall 56. In a test on this arrangement of impingement apertures 60 and effusion apertures 64 is significantly cooler than a previously used cooling arrangement using pedestal cooling downstream of the mixing ports 70. In this test it was observed that there was a reduction in NOX, (Nitrous oxide emissions), and it is believed that the coolant flow from the effusion apertures 64 downstream of the mixing ports 70 may have become entrained by and slightly quenched near wall hot recirculating combustion gases downstream of the mixing ports 70. Thus, the present invention may reduce NOX emissions if provided downstream of the mixing ports.

Figure 6:
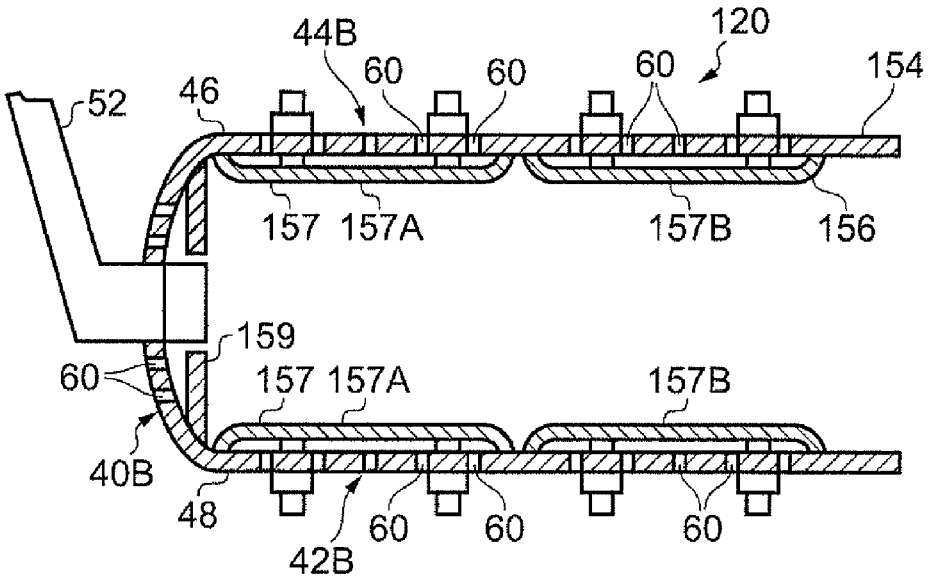
FIG. 6 is an alternative enlarged cross-sectional view through a combustion chamber according to the present invention.

A combustion chamber 120 shown in FIG. 6 is substantially the same as that shown in FIG. 2 and like parts are denoted by like numerals. In the combustion chamber 120 the double wall arrangement of an outer annular wall 44B comprises a fully annular first wall 154 and the second wall 156 comprises a plurality of tiles 157 arranged circumferentially and axially to define an annular second wall 156, arranged radially inwardly of the annular first wall 154. Thus, there is a first plurality of tiles 157A arranged circumferentially side by side, edge to edge, to form an annulus, and a second plurality of tiles 157B arranged circumferentially side by side, edge to edge, to form an annulus. The second plurality of tiles 157B are arranged downstream of the first plurality of tiles 157A but the downstream ends of the first plurality of tiles 157A do not overlap the upstream ends of the second plurality of tiles 157B. The double wall arrangement of the inner annular wall 42B may be arranged similarly. The outer annular wall 44B and the inner annular wall 42B do not have stepped arrangement as do the outer annular wall 44 and the inner annular wall 42 in FIG. 2. The double wall arrangement of the upstream end wall 40B may be arranged similarly, again there are a plurality of heat shields 159 in the second wall arranged downstream from the first wall.

Figure 8:
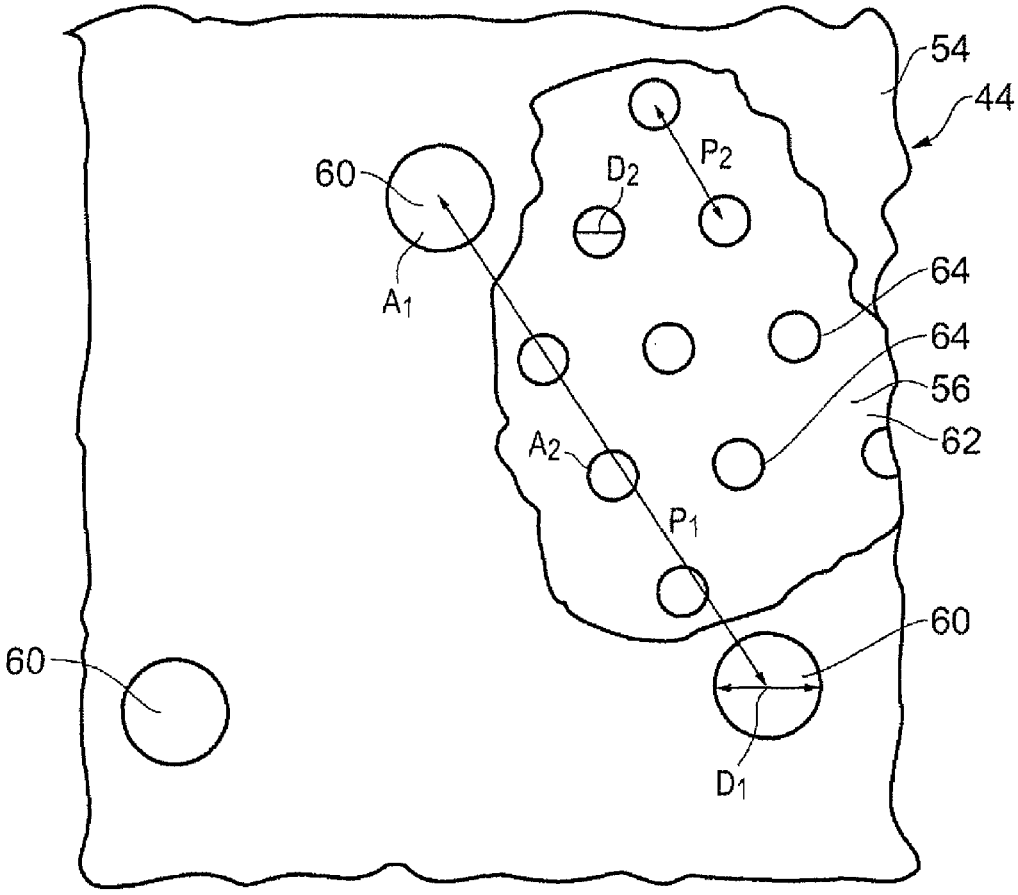
FIG. 8 is a partially cut-away view in the direction of arrow Z in FIG. 7 showing a first and second wall of the combustion chamber.
Figure 7:
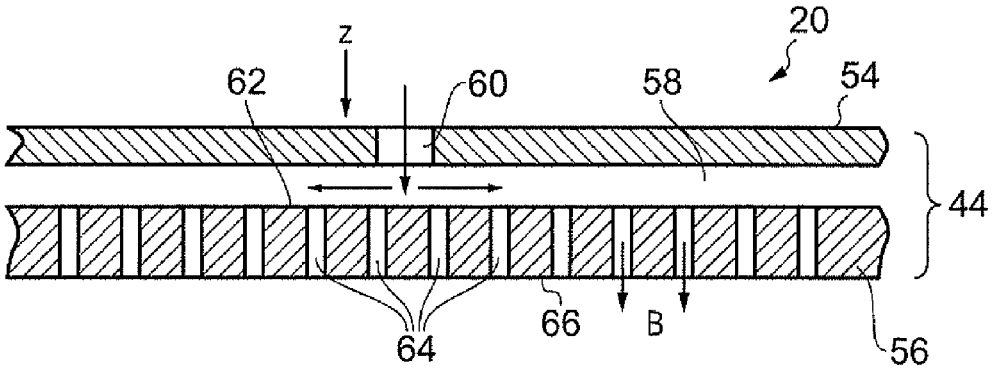
FIG. 7 is a further enlarged cross-sectional view through the combustion chamber shown in FIG. 2.

FIGS. 7 and 8 are similar to FIGS. 3 and 4 but show an alternative arrangement of the effusion apertures 64 in the second wall 56 and in this arrangement the effusion apertures 64 are arranged at an angle of 90° to the inner surface of 66 of the second wall 56.

Figure 9:
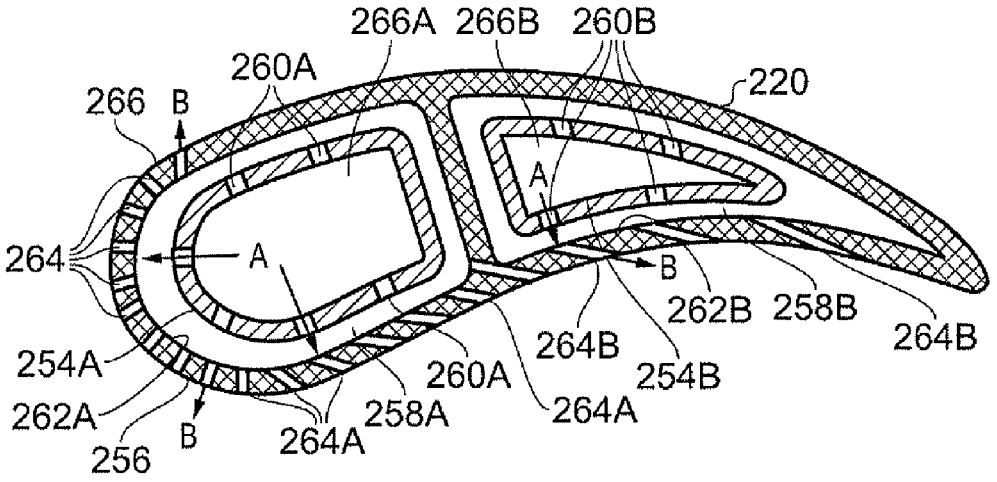
FIG. 9 is a cross-sectional view through a turbine aerofoil according to the present invention.

FIG. 9 shows a turbine aerofoil 220, either a turbine blade or a turbine vane. The turbine aerofoil 220 comprises a double wall arrangement including a first wall 254A and 254B and a second wall 256. The first wall 254A is arranged within and spaced from the second wall 254 to define a cavity 258A between the first wall 254A and the second wall 256. Similarly the first wall 254B is arranged within and spaced from the second wall 254 to define a cavity 258B between the first wall 254B and the second wall 256. The first walls 254A and 254B have a plurality of impingement apertures 260A and 260B respectively extending there-through, whereby during operation a flow of coolant, as shown by arrow A, is arranged to flow from chambers 266A and 266B within the second walls 254A and 254B respectively through the impingement apertures 260A and 260B into the cavities 258A and 258B respectively and impinge upon an outer surface 262A and 262B of the second wall 256. The second wall 256 has a plurality of effusion apertures 264A and 264 extending there-through, whereby in operation a flow of coolant, as shown by arrow B, is arranged to flow from the cavities 258A and 258B through the effusion apertures 264A and 264B respectively to provide a film of coolant on the outer surface 266 of the second wall 256 of the turbine aerofoil 220. The centres of the impingement apertures 260A and 260B are arranged at the corners of an equilateral triangle and the centres of the effusion apertures 264A and 264B are arranged at the corners of an equilateral triangle. The effusion apertures 264A and 264B may be arranged at an angle between 15° and 90° to the surface 266 of the second wall 256.

Although the present invention has been described with reference to the outer annular wall of an annular combustion chamber in which the outer annular wall comprises a first wall, which is an annular wall, and a second wall, which is an annular wall, arranged radially inwardly of the first wall, the present invention is equally applicable to the inner annular wall of an annular combustion chamber in which the inner annular wall comprises a first wall, which is an annular wall, and a second wall, which is an annular wall, arranged radially outwardly of the first wall.

The present invention is also applicable to an annular combustion chamber in which the inner annular wall comprises a first wall, which is an annular wall, and a second wall, which comprises a plurality of tiles arranged circumferentially and axially to define an annular wall, arranged radially outwardly of the first wall or the outer annular wall comprises a first wall, which is an annular wall, and a second wall, which comprises a plurality of tiles arranged circumferentially and axially to define an annular wall, arranged radially inwardly of the first wall.

Although the present invention has been described with reference to an annular combustion chamber it is equally applicable to a tubular combustion chamber in which the first wall is an annular wall and the second wall is an annular wall radially within the first wall. In addition the present invention is applicable to a tubular combustion chamber in which the first wall is an annular wall and the second wall comprises a plurality of tiles arranged circumferentially and axially to define an annular wall radially within the first wall.

Although the present invention has been described with reference to a combustion chamber with an annular first wall and an annular second wall radially inwardly or radially outwardly of the first wall it is equally applicable to a first wall and a second wall downstream of the first wall.

Although the present invention has been described with reference to a combustion chamber it is equally applicable to a turbine blade, a turbine vane or a turbine shroud. A turbine blade, a turbine vane and a turbine shroud has a first wall and a second wall, the second wall is spaced from the first wall to define a cavity between the first wall and the second wall, the first wall has a plurality of impingement apertures extending there-through, whereby during operation a flow of coolant is arranged to flow through the impingement apertures and impinge upon a first surface of the second wall, the second wall having a plurality of effusion apertures extending there-through, whereby in operation a flow of coolant is arranged to flow from the cavity through the effusion apertures and onto a second surface of the second wall.

The invention claimed is:

1. A cooled double walled article comprising:

a first wall;

a plurality of impingement apertures extending through the first wall and having a first diameter, a first pitch that is a distance between centres of two adjacent impingement apertures, and a first area;

a second wall that is spaced from the first wall to define a cavity between the first wall and the second wall; and a plurality of effusion apertures extending through the second wall and having a second diameter, a second pitch that is a distance between centres of two adjacent effusion apertures, and a second area;

wherein:

during operation, a flow of coolant is arranged to flow through the impingement apertures and impinge upon a first surface of the second wall, during operation, a flow of coolant is arranged to flow from the cavity through the effusion apertures and onto a second surface of the second wall, a ratio of the first diameter to the second diameter is at least 3, a ratio of the first pitch to the second pitch is at least 4 and a ratio of the first area to the second area is at least 9, and at least one of the effusion apertures is aligned with one of the impingement apertures.

2. An article as claimed in claim 1 wherein the ratio of the first diameter to the second diameter is at least 4, the ratio of the first pitch to the second pitch is at least 5 and the ratio of the first area to the second area is at least 16.

3. An article as claimed in claim 1 wherein the ratio of the first diameter to the second diameter is 3, the ratio of the first pitch to the second pitch is 4.2 and the ratio of the first area to the second area is 9.

4. An article as claimed in claim 1 wherein the ratio of the first diameter to the second diameter is 4, the ratio of the first pitch to the second pitch is 5.7 and the ratio of the first area to the second area is 16.

5. An article as claimed in claim 1 wherein the effusion apertures have a minimum diameter of 0.5 mm.

6. An article as claimed in claim 1 wherein the effusion apertures have a diameter of 0.5 mm, the second pitch is 2.8 mm, a number of effusion apertures per square inch is 98, the impingement apertures have a diameter of 1.5 mm, the first pitch is 11.7 mm and a number of impingement apertures per square inch is 5.

7. An article as claimed in claim 1 wherein the effusion apertures have a diameter of 0.5 mm, the second pitch is 2.8 mm, a number of effusion apertures per square inch is 98, the impingement apertures have a diameter of 2 mm, the first pitch is 15.6 mm and a number of impingement apertures per square inch is 3.

8. An article as claimed in claim 1 wherein the effusion apertures have a diameter of 0.5 mm, the second pitch is 3.9 mm, a number of effusion apertures per square inch is 49, the impingement apertures have a diameter of 1.5 mm, the first pitch is 16.5 mm and a number of impingement apertures per square inch is 3.

9. An article as claimed in claim 1 wherein the effusion apertures have a diameter of 0.5 mm, the second pitch is 3.9 mm, a number of effusion apertures per square inch is 49, the impingement apertures have a diameter of 2 mm, the first pitch is 22.1 mm and a number of impingement apertures per square inch is 2.

10. An article as claimed in claim 1 wherein the effusion apertures have a diameter of 0.5 mm, the second pitch is 1.9 mm, a number of effusion apertures per square inch is 196, the impingement apertures have a diameter of 1.5 mm, the first pitch is 8.3 mm and a number of impingement apertures per square inch is 11.

11. An article as claimed in claim 1 wherein the effusion apertures have a diameter of 0.5 mm, the second pitch is 1.9 mm, a number of effusion apertures per square inch is 196, the impingement apertures have a diameter of 2 mm, the first pitch is 11 mm and a number of impingement apertures per square inch is 6.

12. An article as claimed in claim 1 wherein the centres of the impingement apertures are arranged at the corners of an equilateral triangle and the centres of the effusion apertures are arranged at the corners of an equilateral triangle.

13. An article as claimed in claim 1 wherein the effusion apertures are arranged at an angle of at least 15° to the surface of the second wall.

14. An article as claimed in claim 1 wherein the article is a combustion chamber, a turbine blade, a turbine vane or a turbine shroud.

15. An article as claimed in claim 14 wherein the article is a combustion chamber, the combustion chamber is a tubular combustion chamber and the first wall is an annular wall and the second wall is an annular wall.

16. An article as claimed in claim 15 wherein the plurality of impingement apertures and the plurality of effusion apertures are arranged over at least a portion of the first wall and at least a portion of the second wall.

17. An article as claimed in claim 16 wherein the at least a portion of the first wall and the at least a portion of the second wall is arranged at a position downstream of a mixing port extending through the first wall and second wall.

18. An article as claimed in claim 16 wherein the plurality of impingement apertures and the plurality of effusion apertures are arranged over all of the first wall and over all of the second wall.

19. An article as claimed in claim 14 wherein the article is a combustion chamber, the combustion chamber is a tubular combustion chamber and the first wall is an annular wall and the second wall comprises a plurality of tiles arranged circumferentially and axially to define an annular wall.

20. An article as claimed in claim 19 wherein the plurality of effusion apertures are arranged over all of at least one of the tiles.

21. An article as claimed in claim 19 wherein the plurality of effusion apertures are arranged over all of each of the tiles.

22. An article as claimed in claim 14 wherein the article is a combustion chamber, the combustion chamber is an annular combustion chamber and the first wall is an inner annular wall and the second wall is an annular wall arranged radially outwardly of the first wall or the first wall is an outer annular wall and the second wall is an annular wall arranged radially inwardly of the first wall.

23. An article as claimed in claim 14 wherein the article is a combustion chamber, the combustion chamber is an annular combustion chamber and the first wall is an inner annular wall and the second wall comprises a plurality of tiles arranged circumferentially and axially to define an annular wall arranged radially outwardly of the first wall or the first wall is an outer annular wall and the second wall comprises a plurality of tiles arranged circumferentially and axially to define an annular wall arranged radially inwardly of the first wall.

24. An article as claimed in claim 14 wherein the combustion chamber is an annular combustion chamber and the first wall is an annular upstream end wall and the second wall comprises a plurality of heat shields arranged circumferentially to define an annular wall arranged downstream of the first wall.

25. An article as claimed in claim 1 wherein a ratio of a number of effusion apertures per square inch to a number of impingement apertures per square inch is equal to greater than 16 and equal to or less than 33.

26. A cooled double walled structure as claimed in claim 1 wherein a ratio of the first pitch to the first diameter is equal to or greater than 5.5 and equal to or less than 11 and a ratio of the second pitch to the second diameter is equal to or greater than 3.8 and equal to or less than 7.8.

* * * * *